US005541478A

United States Patent [19]

Troxell et al.

[11] Patent Number: 5,541,478

[45] Date of Patent: Jul. 30, 1996

[54] ACTIVE MATRIX VACUUM FLUORESCENT DISPLAY USING PIXEL ISOLATION

[75] Inventors: John R. Troxell, Sterling Height; Marie I. Harrington, Troy, both of Mich.

[73] Assignee: General Motors Corporation, Detroit, Mich.

[21] Appl. No.: 205,462

[22] Filed: Mar. 4, 1994

[51] Int. Cl.[6] ..... H01J 1/62

[52] U.S. Cl. ..... 313/497; 313/496; 313/495; 345/75

[58] Field of Search ..... 345/60, 71, 74, 345/75; 313/495, 496, 497

[56] References Cited

U.S. PATENT DOCUMENTS

| | | | |
|---|---|---|---|
| 4,253,044 | 2/1981 | Smith | 315/169.4 |
| 4,410,830 | 10/1983 | DuBois, Jr. | 313/497 |
| 4,486,749 | 12/1984 | Kishino et al. | 345/75 |
| 4,540,983 | 9/1985 | Morimoto et al. | 345/75 |
| 4,617,491 | 10/1986 | Kishino et al. | 313/497 |
| 4,783,651 | 11/1988 | Fischer et al. | 345/71 |
| 4,868,555 | 9/1989 | Watanabe et al. | 345/75 |
| 4,972,116 | 11/1990 | Tatsuda et al. | 313/422 |
| 5,151,632 | 9/1992 | Troxell | 315/169.1 |
| 5,212,472 | 5/1993 | Takahashi et al. | 345/60 |
| 5,235,244 | 8/1993 | Spindt | 313/495 |
| 5,245,249 | 9/1993 | Sakurai et al. | 315/3 |
| 5,347,292 | 9/1994 | Ge et al. | 345/74 |

*Primary Examiner*—Donald J. Yusko
*Assistant Examiner*—Lawrence O. Richardson
*Attorney, Agent, or Firm*—Anthony Luke Simon

[57] ABSTRACT

An active matrix transistor array substrate for a reconfigurable vacuum fluorescent display comprising a set of individually addressable pixels and an isolation grid surrounding each pixel of the set and isolating each pixel of the set from all other pixels of the set. The isolation grid is especially advantageous in a high density active matrix display for preventing one pixel that is switched off from inhibiting a neighboring pixel that is switched on from fully illuminating.

10 Claims, 12 Drawing Sheets

(4 of 12 Drawing(s) in Color)

ACTIVE MATRIX VACUUM FLUORESCENT DISPLAY USING PIXEL ISOLATION

This invention relates to vacuum fluorescent displays and, more particularly, to active matrix vacuum fluorescent displays suitable for providing a high luminance output and/or a high density display.

BACKGROUND OF THE INVENTION

Typical vacuum fluorescent displays include in their structure a filament, a suspended acceleration grid, one or more anodes and one or more phosphors, all enclosed within a sealed package having a low pressure (a vacuum). The filament is heated, such as by an AC current, to a temperature at which it will emit electrons. A suspended acceleration grid biased at a potential higher than a bias of the filament accelerates electrons emitted from the filament toward an anode, also biased higher than the filament bias. On the anode, a phosphor is deposited and emits light in response to the bombardment of electrons emitted from the filament and accelerated by the grid and anode.

It is known to use this vacuum fluorescent display technology in active displays. Such active displays may use either thin film or bulk silicon transistor technology. In the active matrix display, each phosphor element comprises a pixel and is individually controlled by one or more transistors that are selectively addressed. An example system in which redundancy is used to increase display yield is shown in U.S. Pat. No. 5,151,632.

In active matrix displays where high brightness is desired, the filament is placed closer to the anode and phosphors. This lessens the room between the filament and the anode and phosphor for the suspended grid. Once the distance between the filament and anode reaches a certain size, it is no longer practical to suspend an acceleration grid between the filament and the anode and the display is used without the acceleration grid.

It is known that in order to obtain more uniform electron bombardment of the phosphor areas of a conventional vacuum fluorescent display, a wire mesh grid may be physically interposed between the filament and phosphor and biased generally at some intermediate voltage.

It is known that an appropriate alternate electron source of vacuum fluorescent displays is comprised of a class known as field emission sources. These compare to the conventional electron source that is a thermionic filament. Field emission sources include cold cathode emitters, field emission arrays, Spindt cathodes, and other non-thermal electron sources known to those skilled in the art. Electron sources, both thermal and field emission based, are referred to collectively herein by the term "filament."

SUMMARY OF THE PRESENT INVENTION

Advantageously, according to this invention, it is recognized that in an active matrix vacuum fluorescent display there may occur a coupling effect between adjacent pixels that causes the operation of one pixel to affect the operation of a neighboring pixel to a noticeable extent. Ideally, each pixel in the active matrix display is operated completely independently of neighboring pixels. However, according to this invention, it has been found that the biasing of one pixel anode affects the electron bombardment of a neighboring pixel anode.. For example, it has been found that when two neighboring pixels are turned on, they are both at full brightness. Then when one neighboring pixel is turned off and the other remains on, the pixel that remains on is at a reduced brightness. Thus, the operation of individual pixels are undesirably linked.

This coupling or linking of the operation of neighboring pixels is a function of pixel spacing. For example, for very low density vacuum fluorescent matrix displays, there is no coupling effect because the pixels are spaced far enough apart. However, as density of the matrix displays increases, for example, if the distance between adjacent pixels is less than the separation between the pixels and the filament, then the coupling effect is observed. As the spacing of pixels is reduced, as in higher density display implementations, the operational coupling effect becomes more prominent.

Advantageously, according to this invention, there is provided a method and apparatus for eliminating the coupling between neighboring pixels in a vacuum fluorescent display.

Advantageously, according to this invention, a method and apparatus are provided for isolating individual pixels in an active matrix vacuum fluorescent display so that each pixel operates independently of the operation of neighboring pixels or other pixels in the display.

Advantageously, according to this invention, an active matrix vacuum fluorescent display is provided that allows for increased luminance output.

Advantageously, according to this invention, an active matrix vacuum fluorescent display suitable for use in projection systems requiring a high luminance display is provided.

Advantageously, according to this invention, a structure is provided for eliminating coupling or linked operations between neighboring pixels in an active matrix vacuum fluorescent display comprising an active matrix transistor array substrate of a reconfigurable vacuum fluorescent display including a set of individually addressable pixels and an isolation grid surrounding each pixel of the set and substantially isolating the operation of each pixel of the set from all other pixels of the display.

Advantageously, according to one implementation of this invention, a vacuum fluorescent display is constructed to isolate the operation of individual pixels and eliminate coupling of operation between adjacent pixels, the display comprising a base substrate, a thin film transistor array comprising selectively addressable thin film transistors fabricated on the substrate, an insulating layer applied over the thin film transistor array in a pattern providing exposed pixel pads and an isolation grid applied over the insulating layer completely surrounding the exposed pixel pads to provide isolation of the operation of adjacent pixels.

Advantageously, in yet another implementation of this invention, an active matrix vacuum fluorescent display structure is provided for allowing a high brightness vacuum fluorescent display that eliminates the characteristic of pixel coupling between adjacent pixels in the vacuum fluorescent display, the display comprising a silicon wafer substrate, a bulk transistor array fabricated on the silicon wafer substrate, an insulating layer on the bulk transistor array patterned to expose pixel pads for each individually addressable pixel and an isolating grid on top of the insulating layer located between the exposed pixel pads and completely surrounding the exposed pixel pads to operationally isolate each pixel from other pixels in the display.

Advantageously, this invention provides a method of operating a display that provides high brightness, high voltage operation of the display without affecting a crossover of operation between adjacent pixels and providing isolation and independent operation of each pixel. The practicing of this invention in a display comprising a plurality of display elements involves a method of operation comprising the steps of: heating a filament to allow the emission of electrons therefrom, applying a first potential to the filament, biasing a vacuum fluorescent display anode at a second potential greater than the first potential, and biasing, to an isolation potential, an isolation grid that surrounds the biased display element on all sides at an isolating potential to thereby isolate the operation of the biased element from the operation of the remaining display elements. In one implementation, the suitable isolating potential is equal to the second potential.

Advantageously, in yet another implementation of this invention, an active matrix transistor array substrate is provided for a reconfigurable vacuum fluorescent display comprising a set of individually addressable pixels and an isolation grid surrounding each side of each pixel that faces another pixel of the set to isolate each pixel from the set from all other pixels of the set and substantially eliminate operational coupling between neighboring pixels.

A more detailed description of this invention, along with various embodiments thereof is set forth below.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

FIG. 1 (color) illustrates photometric measurements of a vacuum fluorescent display in which all pixels are controlled to be turned on.

FIG. 2 (color) illustrates photometric measurements of a vacuum fluorescent display in which alternating rows of pixels have been turned off and that indicates the coupling affect that the turned off pixels have on the pixels that remain turned on.

DETAILED DESCRIPTION OF THE INVENTION

Figure 1:
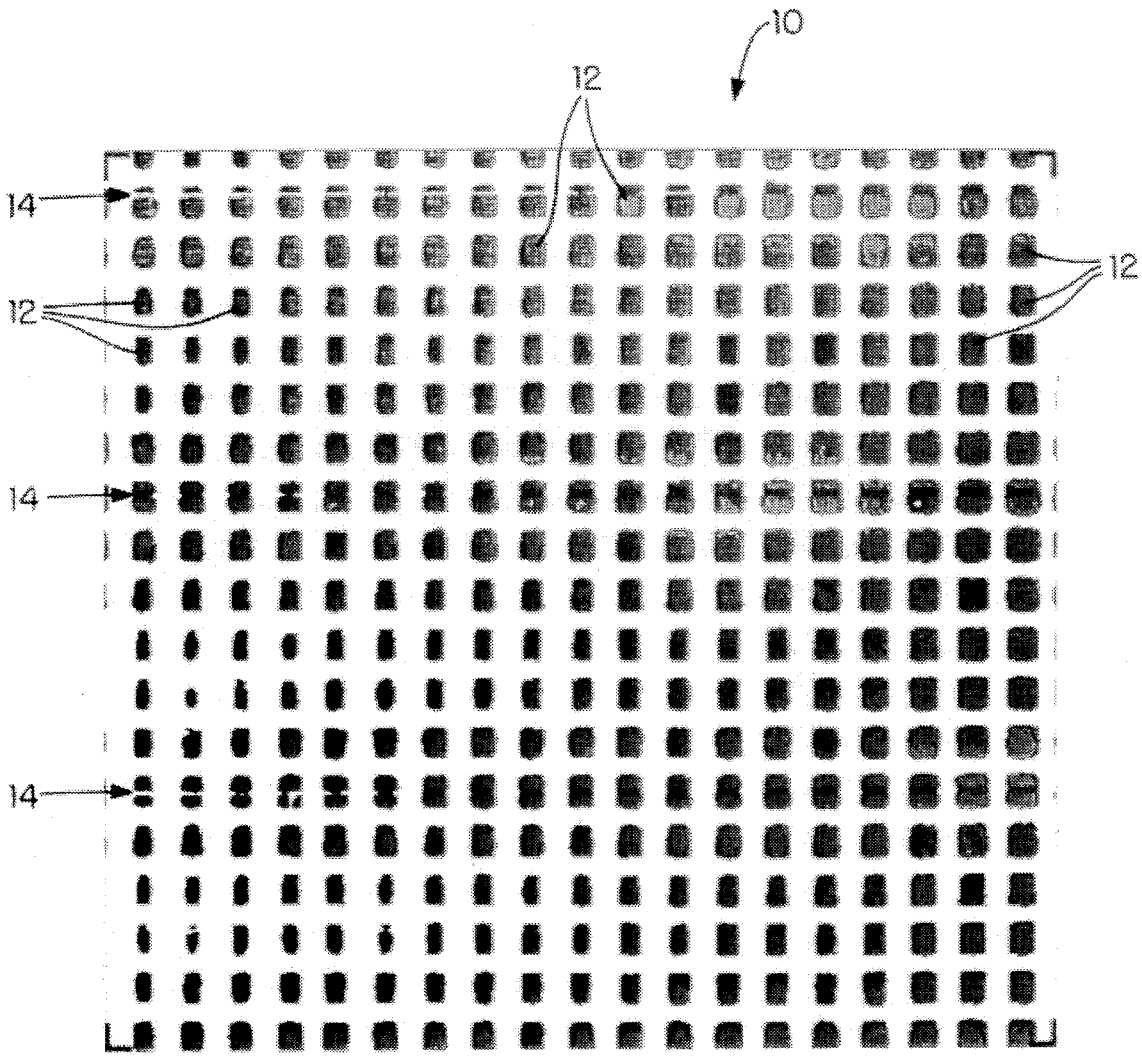
PRIOR ART FIG. 1

Referring to FIG. 1, the photometric data shown is the result of a photometric scan of a portion of a 64×40 pixel active matrix vacuum fluorescent display. The pixel pitch in the display is 450 micrometers and the size of each phosphor dot is approximately 300×300 micrometers. Each pixel registering in the photometric scan outputs at least 400 foot Lamberts (Blue) of luminance. Green portions of the scan represents photometric output of higher than 700 foot Lamberts and red portions represent photometric outputs higher than 950 foot Lamberts.

Reference 14 illustrates the shadow of the filament wires over the pixels 12 and the display portion 10, which can be seen in three places, as indicated. The distance between the filament wires and the pixels is between 1.5 mm and 2 mm. Apparent differences in pixel dimensions, shown in FIG. 1, are due to variations in phosphor luminance and addressing transistor performance.

Figure 2:
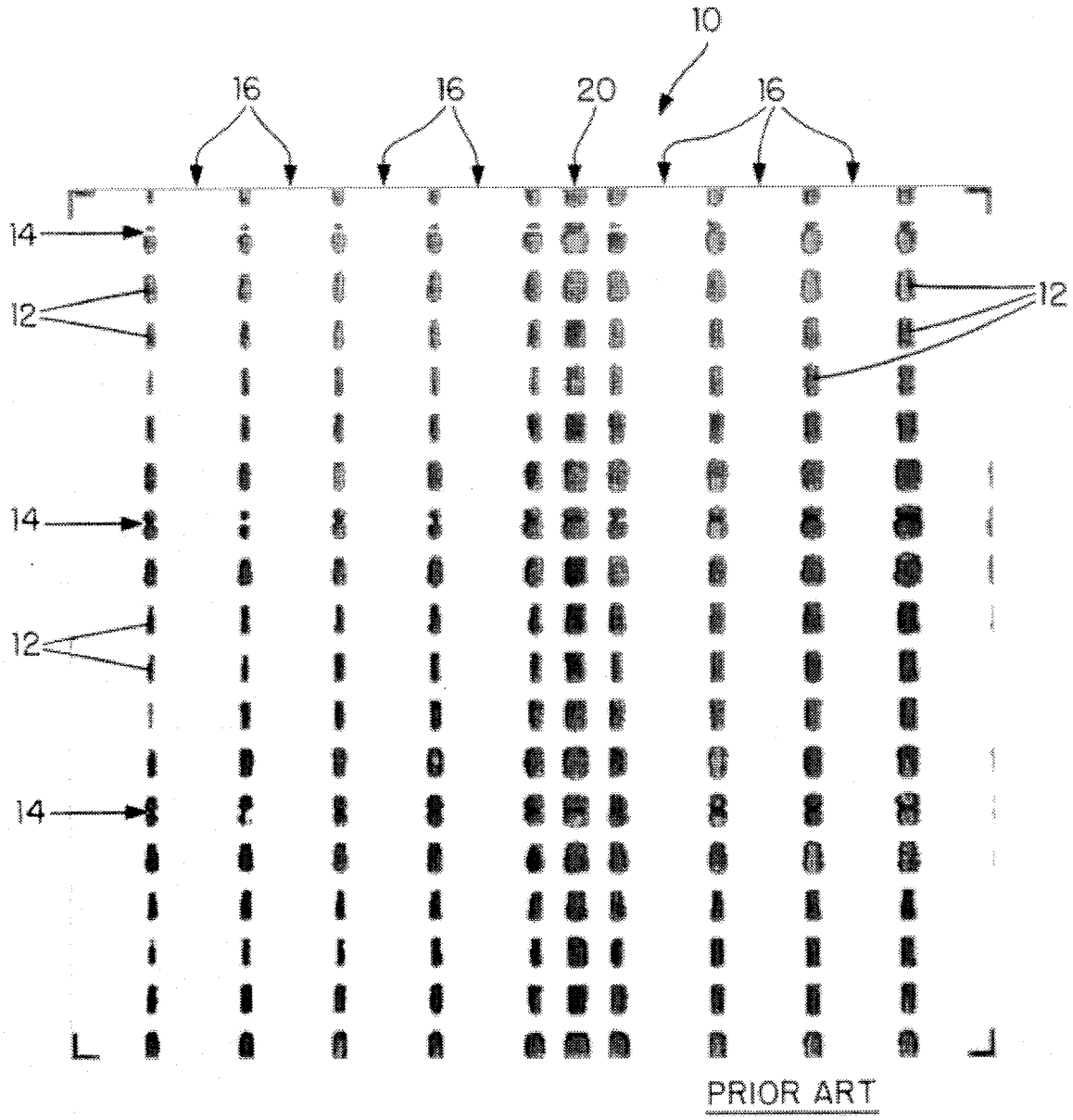

Referring to FIG. 2, the same portion 10 of the 64×40 pixel active matrix vacuum fluorescent display is shown, now with alternating columns 16 of pixels turned off. A short in the display addressing circuitry has caused column 20 to remain on. In all the cases where a pixel that is on is neighbored by a pixel in one of the columns that has been turned off, the portion of the pixels that emit light is significantly smaller than the same portions shown in FIG. 1, illustrating all pixels turned on. As can be seen, for each pixel, the shrinkage in the portion of the pixel that emits light is on the side of the pixel that adjoins a pixel that is commanded to be turned off. From this observation, it is apparent that the operation of neighboring pixels are not completely independent from each other, as would be desired.

FIGS. 1 and 2 show that there is some coupling of the operation of neighboring pixels so that the on and off status of each pixel can affect the operation of its neighboring pixel. More specifically, whether one pixel is on or off affects the amount of light output of the neighboring pixels that may be turned on. It appears that this coupling between neighboring pixels results in turned-off pixels impeding pan of the flow of electrons to turned-on pixels, which results in the reduced light emission from the turned-on pixels shown.

Figure 3:
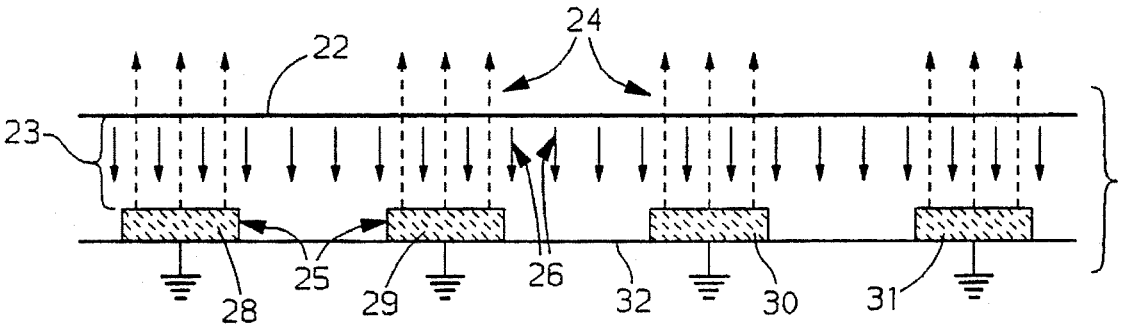
FIG. 3 schematically illustrates idealized operation of a vacuum fluorescent display.

Referring now to FIG. 3, the schematic illustration of a vacuum fluorescent display and its operation includes filament 22 and phosphor coated pixels 28, 29, 30 and 31 on a substrate 32. The filament 22 is resistively heated with an AC current and is biased to a voltage below ground. The heating of the filament 22 allows the emission of electrons in response to an applied voltage potential. The filament 22 is at a vertical distance 23 from the top of pixels 28, 29, 30 and 31. The anodes 328, 329, 330 and 331 of each of the pixels 28, 29, 30 and 31 are grounded as shown, creating a potential between the filaments 22 and the anodes and driving electrons from the filament 22 towards the pixels 28, 29, 30 and 31. The electrons are represented by reference 26. The distance between adjacent pixels 28 and 29, illustrated by reference 25, is representative of the spacing of the pixel array.

In response to the bombardment of electrons 26, the pixels 28, 29, 30 and 31 emit light 24 to create visible vacuum fluorescent display elements.

Figure 4:
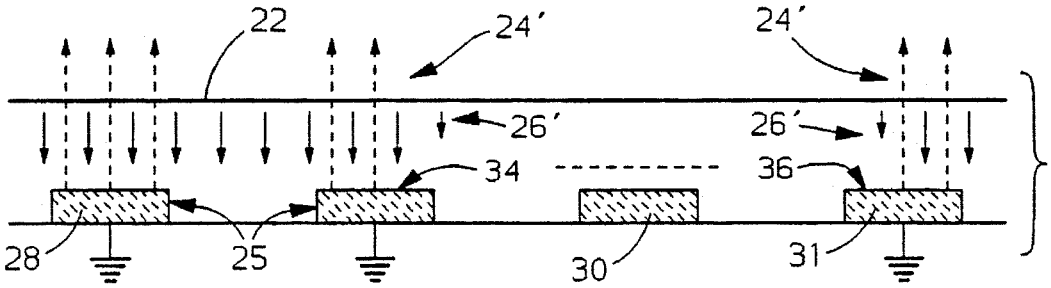
FIG. 4 schematically illustrates undesirable coupling in a vacuum fluorescent display.

Referring to FIG. 4, pixel 30 is now turned off by having the ground bias removed. Without the influence of pixel 30 being biased to ground, the flow of electrons 26' from filament 22 is reduced toward the portions of pixels 29 and 31 closest to pixel 30. The result is a reduced emission of light 24' from pixels 29 and 31 with virtually no light emitting from the portions 34 and 36 of pixels 29 and 31, closest to pixel 30.

Advantageously, this invention provides an advantageous structure and method of operation for eliminating the above described coupling affect of adjacent pixels in an active matrix display.

Figure 5:
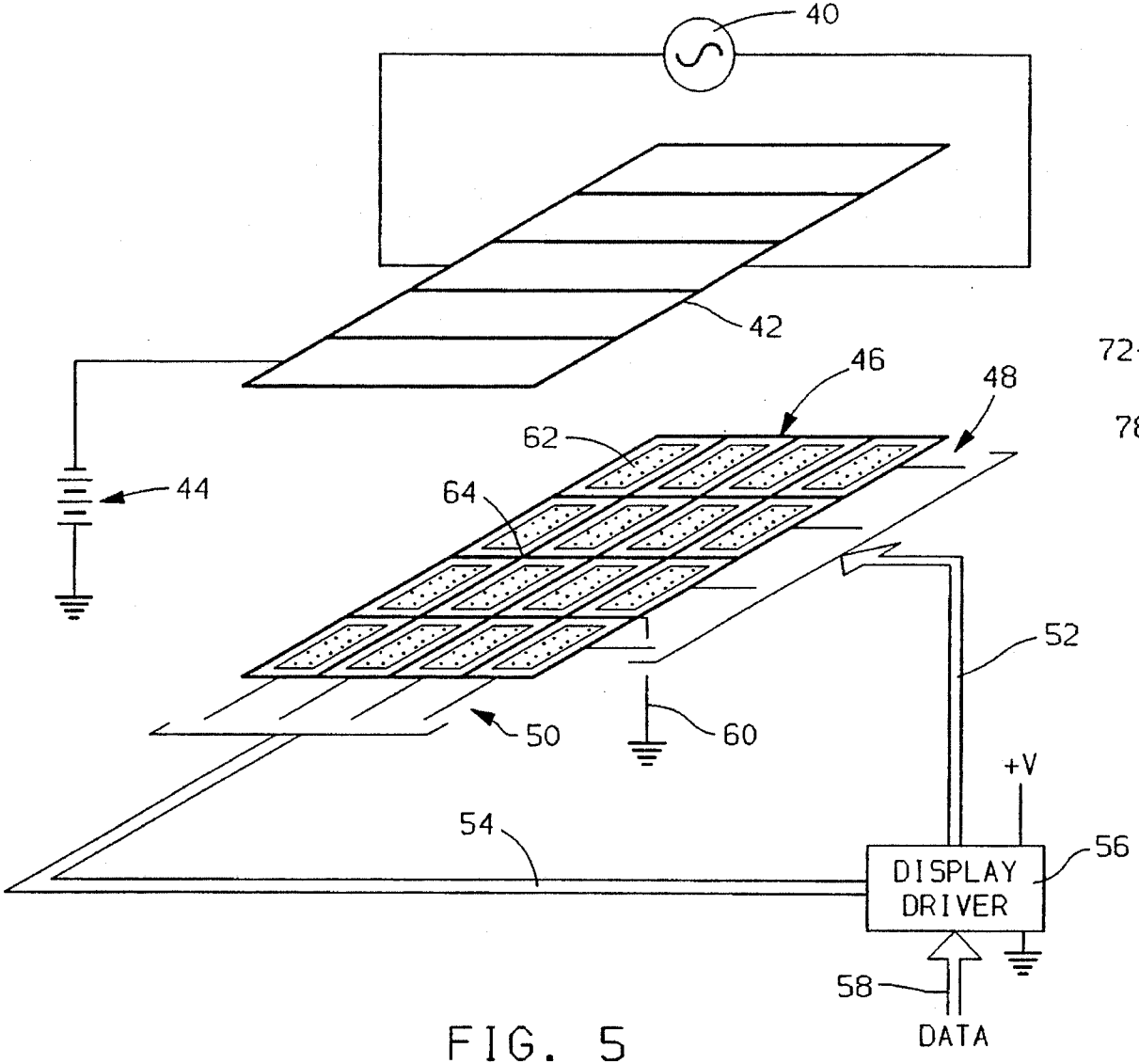
FIG. 5 schematically illustrates the method and apparatus of this invention.

Referring now to FIG. 5, the schematic shown illustrates the apparatus and operational method of this invention and includes AC current source 40, filament 42, filament bias 44, array 46 including individual pixels 62 and an isolation grid 64. The array 46 has column electrodes 50, row electrodes 48 and a display driver 56. The filament 42 is heated resistively with an AC current provided from AC current source 40 in a manner well known to those skilled in the art. A voltage bias 44 biases the filament 42 at a voltage level below ground. The display 46 includes a plurality of pixels 62 that are individually controlled through any known manner of active matrix pixel control selectively coupling an anode (not shown) for each pixel 62 to ground to thereby cause a flow of electrons from the filament 42 to the anode of the pixel 62 wherein the pixel 62 emits light.

Isolation grid 64 completely surrounds and isolates each pixel 62 that is surrounded by neighboring pixels on all sides. For pixels 62, along the edge of the display, isolation grid 64, in this example, completely surrounds the pixels 62.

The pixels are controlled through row and column electrodes 48 and 50, controlled by row and column address busses 52 and 54. Display driver 56, of a type well known to those skilled in the art, provides the signals to busses 52 and 54 and may be responsive to data provided on bus 58 in a known manner. The circuit construction of the pixel-driving transistors may be that shown in U.S. Pat. No. 5,151,632, assigned to the assignee of this invention.

The isolation grid 64 is biased to a voltage suitable for isolating the neighboring pixels. An example of such a suitable voltage is ground. However, depending on the operation desired and the physical construction, the voltage applied at line 60 may be higher than ground or may range between ground and the voltage of filament 42.

Figure 6:
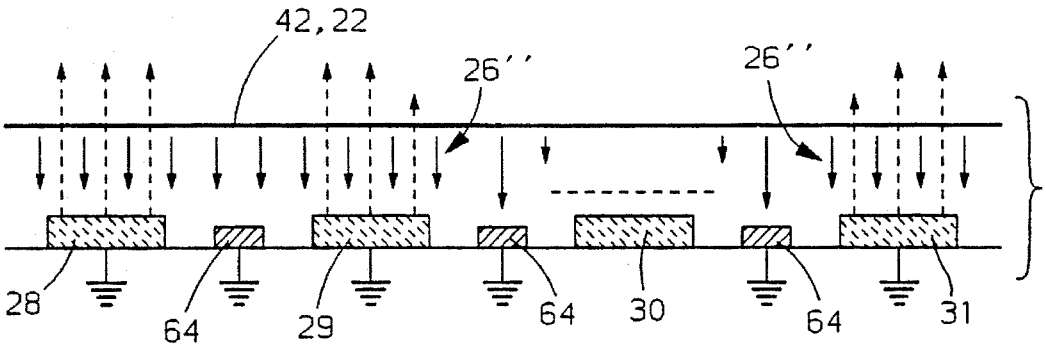
FIG. 6 illustrates schematically the operation of this invention.

Referring now also to FIG. 6, the operation of the apparatus and method of this invention shown in FIG. 5 is explained schematically. The filament 42, corresponding to filament 22 in FIGS. 3 and 4, is biased as described above and emits electrons, which are attracted to the selected pixels 62 (via the on-biased anodes), which selected pixels are referenced 28, 29, and 31 in FIG. 6.

The isolation grid 64 between each two adjoining pixel sides is biased to ground. Pixel 30 is turned off and is not biased to ground. In contrast to FIG. 4, this invention allows pixel 30 to be turned off without dramatically affecting the flow of electrons 26" to pixels 29 and 31. Isolation grid 64 provides enough bias that a flow of electrons across the complete surface of pixels 29 and 31 is maintained while the flow of electrons to pixel 30 remains terminated. Thus, the desirable independent operation of each pixel is established and the operational coupling, the dependence of each pixel on its neighboring pixel, is eliminated.

The method of this invention operationally illustrated with reference to FIGS. 5 and 6, provides for the substantial elimination of operational coupling between adjacent pixels in a vacuum fluorescent display and improved independent operation of each pixel in the display comprising a plurality of display elements. These advantages are achieved without sacrifice to either display density or display brightness.

The method of operating the display according to this invention to advantageously achieve the elimination of operational coupling between adjacent pixels of an active matrix vacuum fluorescent display is embodied in the steps of: (a) heating the filament 42 to allow the emission of electrons therefrom; (b) applying a first potential to the filament 42; (c) biasing at least one of the display elements 62 at a second potential greater than that of the first potential; and (d) biasing the isolation grid 64 that surrounds the biased display element on all sides at an isolating potential to thereby isolate the operation of the biased element from the operation of the remaining display element.

Figure 7:
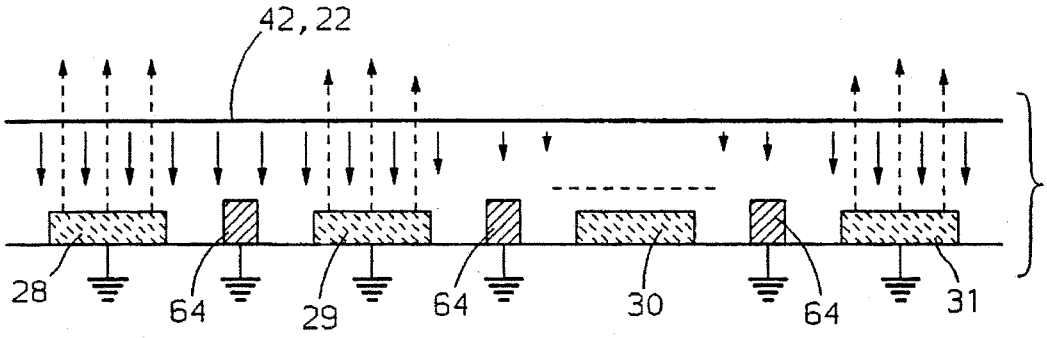
FIG. 7 illustrates schematically a second example of the operation of this invention.

Referring now to FIG. 7, another example implementation is schematically shown. In FIG. 7, the grid 64 is built up so that the portion closest to filament 22 is at the height of or higher than the height of the phosphor on the elements 62. From implementation to implementation, variation in the height of the grid 64 may be made to control the effect of the grid 64 on the display. For example, a grid closer to filament 22 may provide better control or require less voltage bias than the grid 64 shown in FIG. 6.

EXAMPLE 1

As recited above, the apparatus of this invention may be fabricated using thin film transistor technology on a suitable substrate. A silicon wafer with a 1 micron silicon dioxide surface layer, is used as a suitable starting substrate. A glass substrate can be used as an alternative. The advantage of using the silicon wafer as the substrate is that conventional integrated circuit manufacturing facilities may be used to fabricate the transistor arrays. The wafer may be tied to ground to minimize back-channel effects in the thin film transistors. Alternatively, bulk silicon transistors may be fabricated, which may offer superior performance to thin film transistors.

A polycrystalline thin film transistor layer is fabricated on top of the silicon wafer. The implementation of polycrystalline thin film transistors for active matrix vacuum fluorescent displays well known to those skilled in the an and the details of such an implementation need not be set forth herein. The transistor circuit set forth in U.S. Pat. No. 5,151,632 may be desirable. On top of the thin film transistor layer, an insulation layer is selectively applied. The insulation layer is selectively applied so that the pixel element anodes or pads, which are electrically connected to the drains of the drive transistors for each pixel, are not covered. Likewise, electrical contact pads for the row and column electrodes are also not covered by the insulation layer.

The insulation layer may be applied in multiple coatings. For example, a 4000 angstrom coating of silicon dioxide may be applied, upon which a 4000 angstrom coating of silicon nitride may be applied. The multiple layer approach helps eliminate the effect of possible pinholes in any one layer of insulation. A third layer of silicon dioxide may be provided on top of the layer of silicon nitride. Using the silicon dioxide layers on either side of the silicon nitride layers prevents possible reactivity arising from the silicon nitride contacting with either the aluminum pads or the aluminum isolation grid layer described below. Techniques for the application and photolithographic patterning of silicon dioxide and silicon nitride are well known to those skilled in the art.

Contact holes are then etched through this insulator sandwich. Etching of the silicon dioxide and silicon nitride layers may be performed using exclusively dry etching techniques, as is known to those skilled in the art. Alternatively, in order to minimize erosion of the photoresist masking layer, it may be desirable to etch through the top silicon dioxide layer using a wet chemical (hydrofluoric acid based) etch, followed by a dry (plasma) etch of the silicon nitride layer, followed by a wet chemical etch of approximately 200 nm of the lower silicon dioxide layer, followed by a dry (plasma) etch of the final 200 nm of silicon dioxide. It is useful to avoid wet chemical etching of silicon dioxide in the presence of exposed aluminum layers in order to minimize damage to the aluminum film resulting from chemical attack by the hydrofluoric acid. Thus, the aforementioned process stops chemical etching of the lower silicon dioxide layer when approximately 200 nm of silicon dioxide still remains, and utilizes a plasma etching step to complete contact hole formation without damaging the underlying aluminum.

After the contact holes are opened, aluminum is deposited thereon. It should be noted that aluminum is generally preferred as a metallization film for this purpose, but that other metals, including for example chromium, may also be used. One preferred technique for depositing this aluminum film is by sputtering. In this manner, the surface to be coated with aluminum is first sputter etched for about 1 minute, using argon, in order to remove any oxide coating from any exposed metal that may be required to contact the aluminum layer being deposited. The aluminum film is then deposited to a thickness typically between 100 nm and 1000 nm, 1000 nm being generally preferred. The grid pattern is then transferred to the aluminum film by photolithographic means, as is well known to those skilled in the art of semiconductor device fabrication. This pattern is then etched into the aluminum film typically by wet chemical etching of the aluminum in a phosphoric acid based etchant typically used by those skilled in the art of semiconductor device fabrication.

Figure 10:
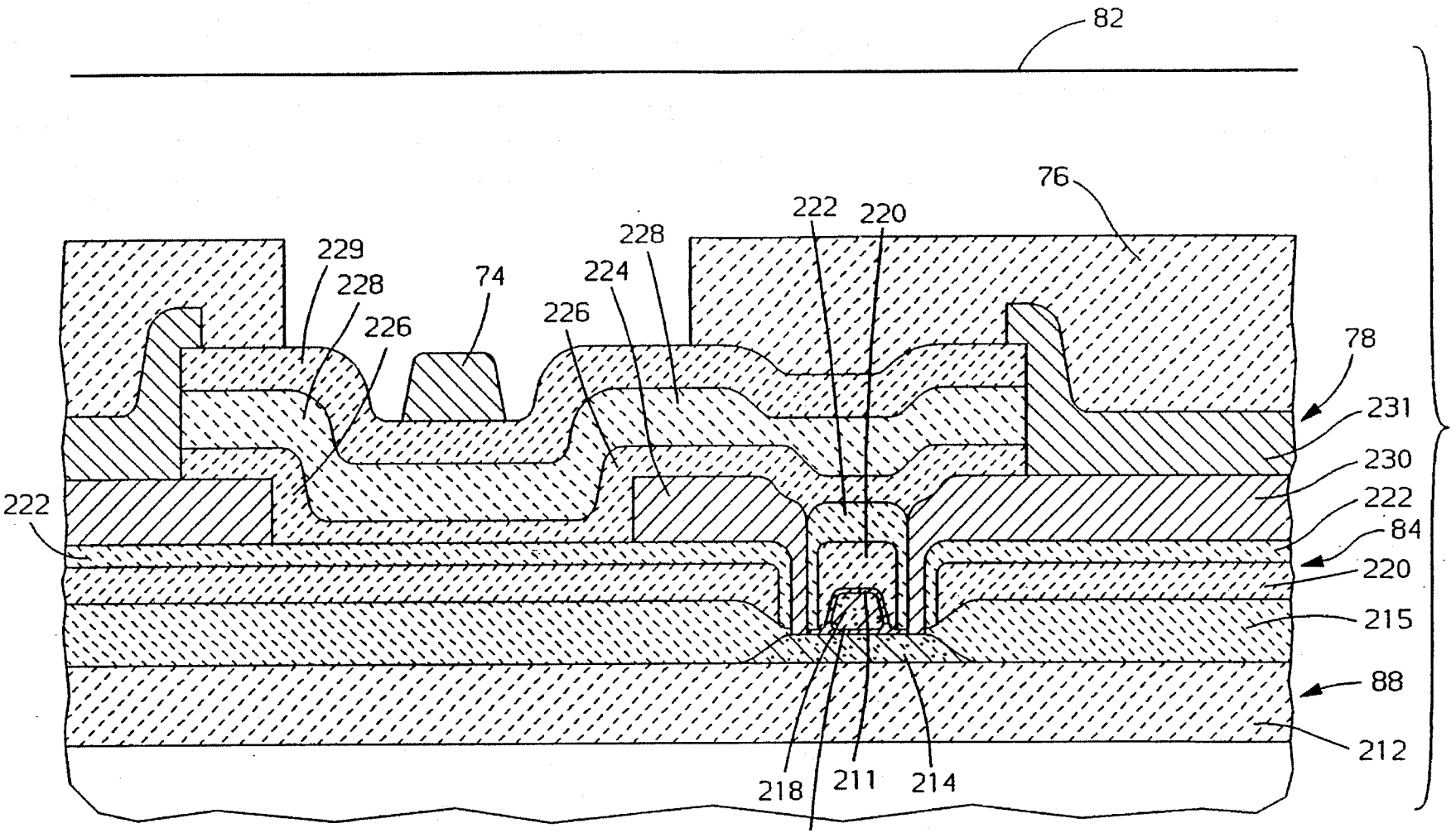
FIG. 10 illustrates a cross-section of a second example apparatus of this invention.

An alternative approach is not to remove any metal that directly overlays exposed metal from the previous metal layer. An example of this alternative is shown in FIG. 10 (described below), wherein all portions of the first metal layer that are exposed by openings in the insulation layer are covered, and thereby protected, by the second or isolation grid metallization layer.

Next, the phosphor is applied to the display pads using a screen printing or photolithographic technique known to those skilled in the art of constructing vacuum fluorescent displays. The phosphor is typically in the range of 25 to 50 microns thick, resulting in a top surface that is closer to the filament than the grid.

Advantageously, according to one implementation of this invention, the top surface of the aluminum grid metal film is at a height comparable to the height of the subsequently deposited phosphor film, offering some advantageous performance characteristics in the isolation of adjacent pixels. In this approach, the top of the aluminum film might be 25 μm above the insulator surface. This may be achieved by depositing a very thick conductive film, or by depositing a thick insulating film followed by a 1 μm aluminum film as described above. Possible insulating structures include a polyimide layer in which a polyimide suitable for annealing at temperatures in the range of 400°–500° C. must be used. An alternative method is to screen print an insulation layer on top of the insulation layer mentioned above, and to apply the aluminum grid on top of this thick film insulator.

The remainder of the display is constructed in a known manner, which includes packaging, making electrical connections to the contact electrodes and sealing the vacuum fluorescent display unit. Such processes are well known to those skilled in the an and need not be set forth in more detail herein.

EXAMPLE 2

Figure 8:
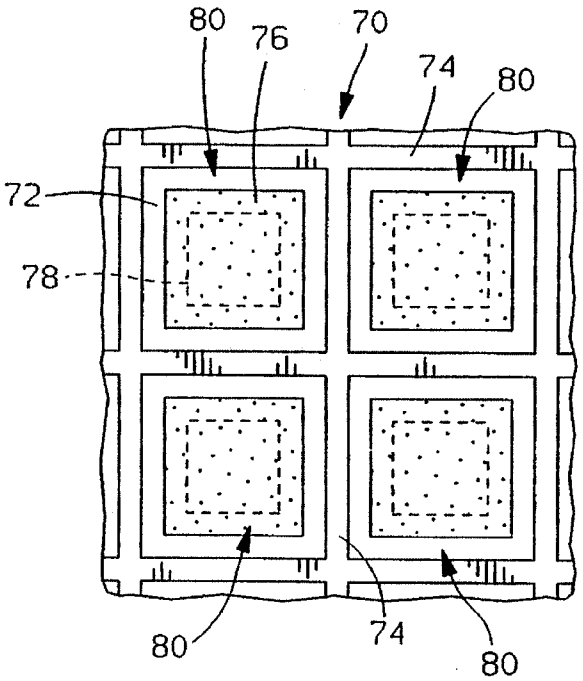
FIG. 8 illustrates the apparatus of this invention.

Referring now to FIG. 8, a portion of a display according to this invention is shown. The portion of the display 70 shown includes 4 pixels 80, each of which comprises a phosphor 76 on an aluminum pad 78, which is the pixel anode. The pads 78 are not covered by insulating layer 72, while the insulation layer 72 covers the remainder of the thin film transistor layer. The grid 74 comprises aluminum, surrounds each of the pixels 80 and is biased, for example, to ground, to operatively isolate each pixel 80 from operational association with its neighboring pixel 80. The thin film transistor structures that control the bias applied to the pads 78 and that are located under the insulation layer 72 are known to those skilled in the art.

Thus, the apparatus of this invention, as shown in FIG. 8, comprises an active matrix transistor array substrate of a reconfigurable vacuum fluorescent display comprising a set of individually addressable pixels 80 and an isolation grid 74 surrounding each pixel 80 of the set of pixels and isolating each pixel 80 from all the other pixels 80 in the set.

Figure 9:
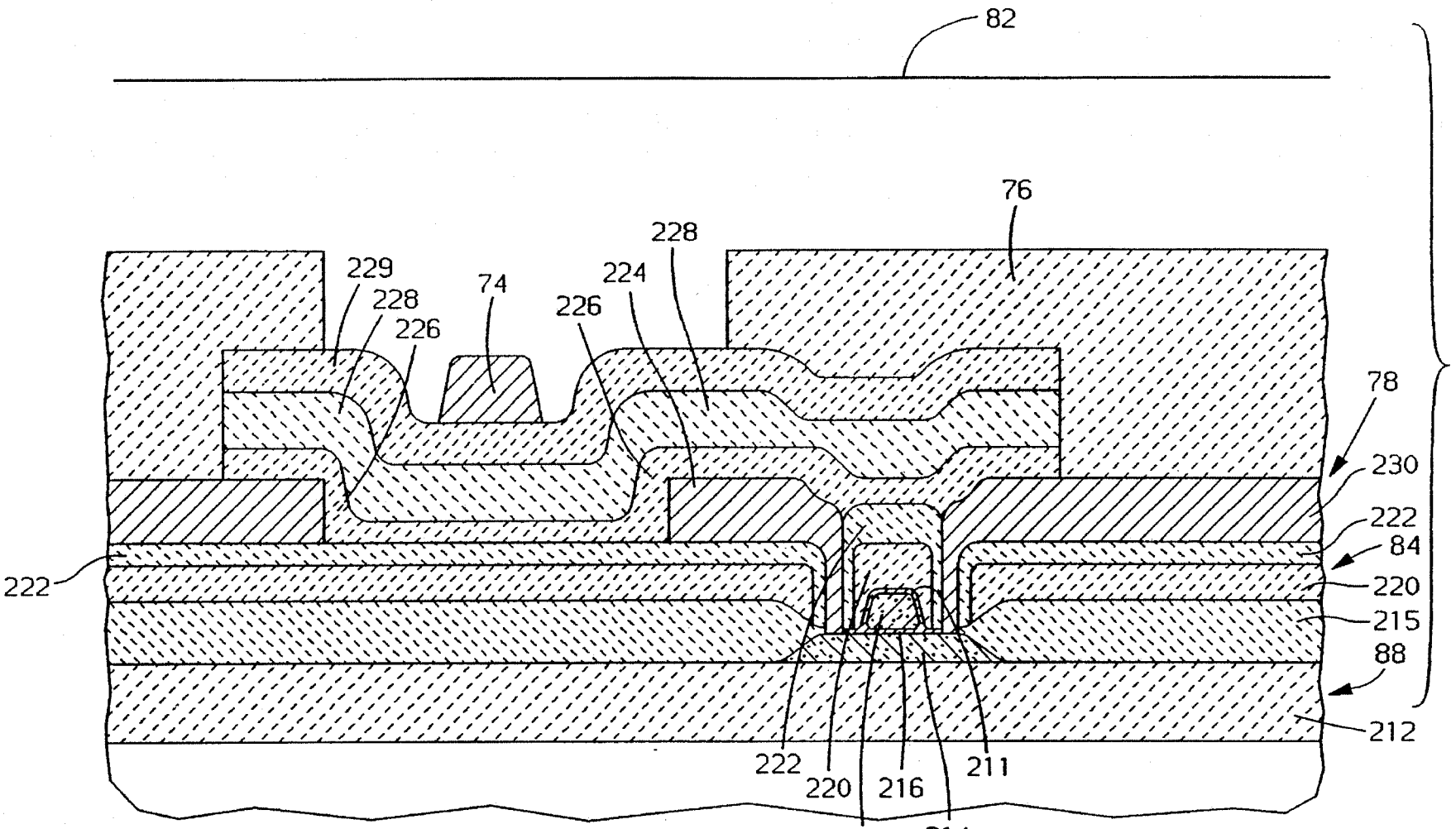
FIG. 9 illustrates a cross-section of an example apparatus of this invention.

Referring now to FIG. 9, a cross-section of an example implementation of the apparatus shown in FIG. 8 is shown and also includes the filament 82, thin film transistor layer 84, and a base substrate 88 to which the components fabricated thereon are mounted.

The example apparatus shown in FIG. 9 includes thin film transistors fabricated on a substrate wafer 88 which may either be an oxidized silicon substrate or a glass substrate. In the implementation a silicon wafer, the wafer is oxidized to obtain a silicon dioxide layer 212 of 1 μm in thickness, which actively isolates the active thin film transistor layer from the single crystal silicon substrate. In implementation of the apparatus on a glass substrate, layer 212 is replaced with a silicon nitride ($Si_3N_4$) film, which completely encapsulates the glass substrate. The silicon nitride film acts as an ionic barrier that isolates the thin film transistor layer from contaminants in the glass, particularly sodium. The silicon nitride layer is deposited using a low pressure chemical vapor deposition (LPCVD) and is typically in the area of 1000 Angstroms thick. On top of the silicon nitride layer, a silicon dioxide layer of approximately 1 μm thick is deposited. This silicon dioxide layer prevents the nitride layer from becoming conductive after subsequent doping processes.

At this point, the building of thin film transistors on the substrate can begin. In this example, the fabrication of the p-channel transistor will be explicitly described and it will be apparent to one skilled in the art that the same techniques can be used to build correspondingly similar n-channel transistors. An active silicon layer is deposited by LPCVD at temperatures ranging from 525° C. to 625° C. depending on whether amorphous or polycrystalline silicon is desired. Typically a thickness of 1500 angstroms to 2000 angstroms is desirable for this silicon layer. If the silicon as deposited is amorphous, a silicon ion implant (2E15, 170 keV) followed by a crystallization anneal is useful to achieve grain growth. The anneal may be achieved by rapid thermal annealing (RTA, 700° C. for 5 minutes in $N_2$ ambient) or in a conventional annealing furnace for times up to 60 hours at temperatures ranging from 540° C. to 800° C., 600° C. being preferred.

Next a thin layer of silicon dioxide (200 to 500 angstroms) is thermally grown on the surface of the active silicon in a known manner. On top of the silicon dioxide layer, a silicon nitride layer, 1000 Angstroms thick, is deposited by LPCVD.

This silicon nitride layer is then patterned photolithographically to define the active silicon regions. The silicon nitride layer is etched away (i.e., by plasma etching) leaving islands of silicon nitride with pads of silicon dioxide underneath. After stripping the photoresist used in the etching in a known manner and RCA cleaning the substrates, the substrates are subjected to an oxidation at 800° C. in steam ambient for times up to 70 hours. The exposed silicon is completely consumed during this oxidation, leaving silicon dioxide 215 isolated islands of silicon 214 with pad silicon dioxide and silicon nitride on top of the islands 214. The silicon nitride layer is then etched off by wet chemical etching. The wafers are again cleaned and further oxidized to achieve a 800 Angstrom to 1000 Angstrom thick total silicon dioxide layer 216 on top of the islands 214. The silicon dioxide layer 216 acts as the gate oxide for the thin film transistor.

Next, a 5000 Angstrom polycrystalline silicon layer is deposited using LPCVD at 625 C. This layer is then patterned photolithographically to form the gate structure 218 of the thin film transistor. The polycrystalline silicon is etched using plasma etching and the photoresist is removed. The source and drain regions are next formed using ion implantation of $BF_2$ (3E15, 125 keV). A lightly doped drain (LDD) region is formed by photolithoghraphically patterning and etching a small region of the gate polysilicon away on the drain side of the thin film transistor and then providing a low dose implant, i.e., $BF_2$, 1.5E13, 125 keV. An alternate approach to forming the LDD region is to do a blanket low dose implant ($1.5\times10^{13}$ $cm^{-2}$) and then do the source and drain implant through a photoresist mask so that the LDD regions do not receive this implant. The substrate with the ion implants is then annealed at 800° C. in a steam ambient followed by dry $O_2$ and finally a $N_2$ambient. This forms the thin layer of silicon dioxide 211 enclosing the polysilicon gate 218.

A silicon nitride layer 220 is deposited by plasma enhanced chemical vapor deposition (PECVD) (temperature range between 250° and 300° C., which affects a migration of the hydrogen from the nitride into the silicon layer 216, RF frequency range of approximately 50 KHz). This film is 0.8 to 1.2 μm thick, approximately 1 μm being preferred, and has approximately a 20% hydrogen content. The silicon nitride layer 220 is patterned photolithographically to define contact holes and etched with plasma etching down to the oxide 216 on top of the polysilicon 214. A LPCVD silicon dioxide film 222, 3500 Angstroms thick, is deposited on top of the nitride. Silicon dioxide film 222 is patterned photolithographically to define smaller contact holes inside the original contact holes. This oxide and the underlying silicon dioxide (part of layer 216) are etched using BHF. The photoresist is removed and Al-1%Cu-1%Si metal is sputtered on to a thickness of 1 to 1.5 μm. The metal is patterned photolithographically to form interconnects 224 and is etched by a wet chemical process. The silicon residue that remains after the chemical etch is removed using a $CF_4$ plasma etch. This completes the thin film transistor structure.

The array of thin film transistors is encapsulated using an oxide-nitride-oxide sandwich. Approximately 4000 Angstroms of silicon dioxide 226 is deposited by LPCVD, followed by approximately 4000 Angstroms of plasma enhanced CVD silicon nitride 228 and approximately 4000 Angstroms of LPCVD silicon dioxide 229. Alternatively, all three insulation layers may be sequentially deposited by plasma-enhanced CVD. These layers 226 and 228 are patterned photolithographically to open holes to the bonding pads 230 for the pixels. All other portions of the transistor array remain buried under the protective insulator layers. The etching of these layers is accomplished with plasma etching.

The metal for the isolation grid 74 is deposited on top of the insulator sandwich comprising layers 226 and 228. The metal layer (typically either aluminum or Al-Cu-Si alloy) generally is between 2000 angstroms and 1.5 μm in thickness, the latter being preferred in order to minimize step coverage problems. The grid metal is then patterned, i.e., photolithographically, and etched to form the isolation grid 74.

The phosphor pixels 76 are then formed in accordance with any of the methods mentioned herein or according to any known method.

FIG. 10 is a cross section of an alternative implementation of the apparatus shown in FIG. 8, in which, as described above, the grid metalization layer is not removed where the layer covers exposed metal, such as aluminum 231 above aluminum pad 230, forming an additional layer 231 upon which the phosphor pixel 76 is formed.

Figure 11:
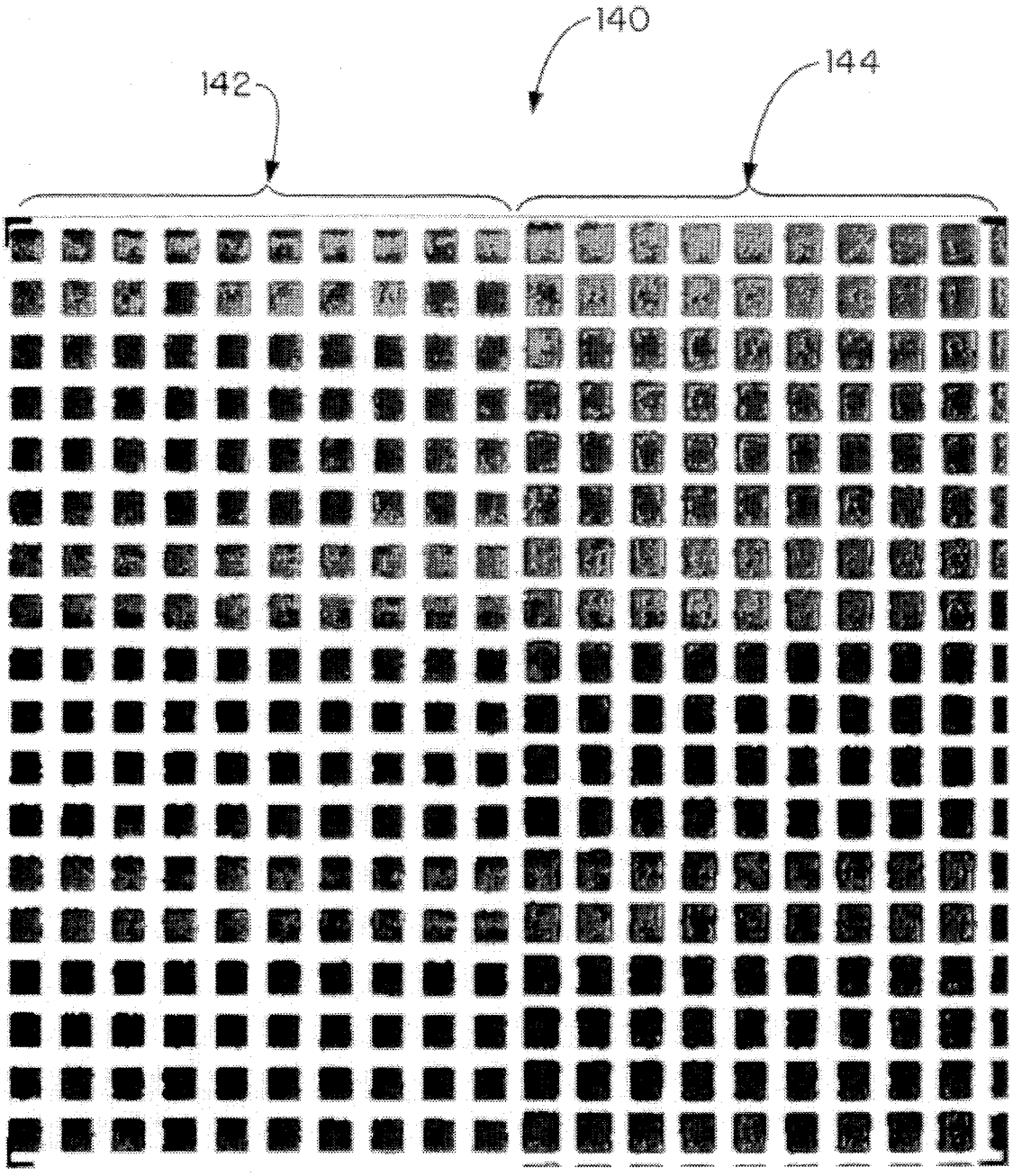
FIG. 11 (color) illustrates photometric data of two sets of pixels, one including the apparatus of this invention and one not including the apparatus of this invention.

Referring to FIG. 11, photometric data of a display according to this invention is shown. The display 140 comprises a set of pixels 142 according to this invention and a set of pixels 144 not including the isolating grid according to this invention. All of the pixels of the display are commanded on. The pixels 142 are sized slightly smaller than the pixels 144 to accommodate the isolating grid (not shown in the Figure) between the pixels.

Figure 12:
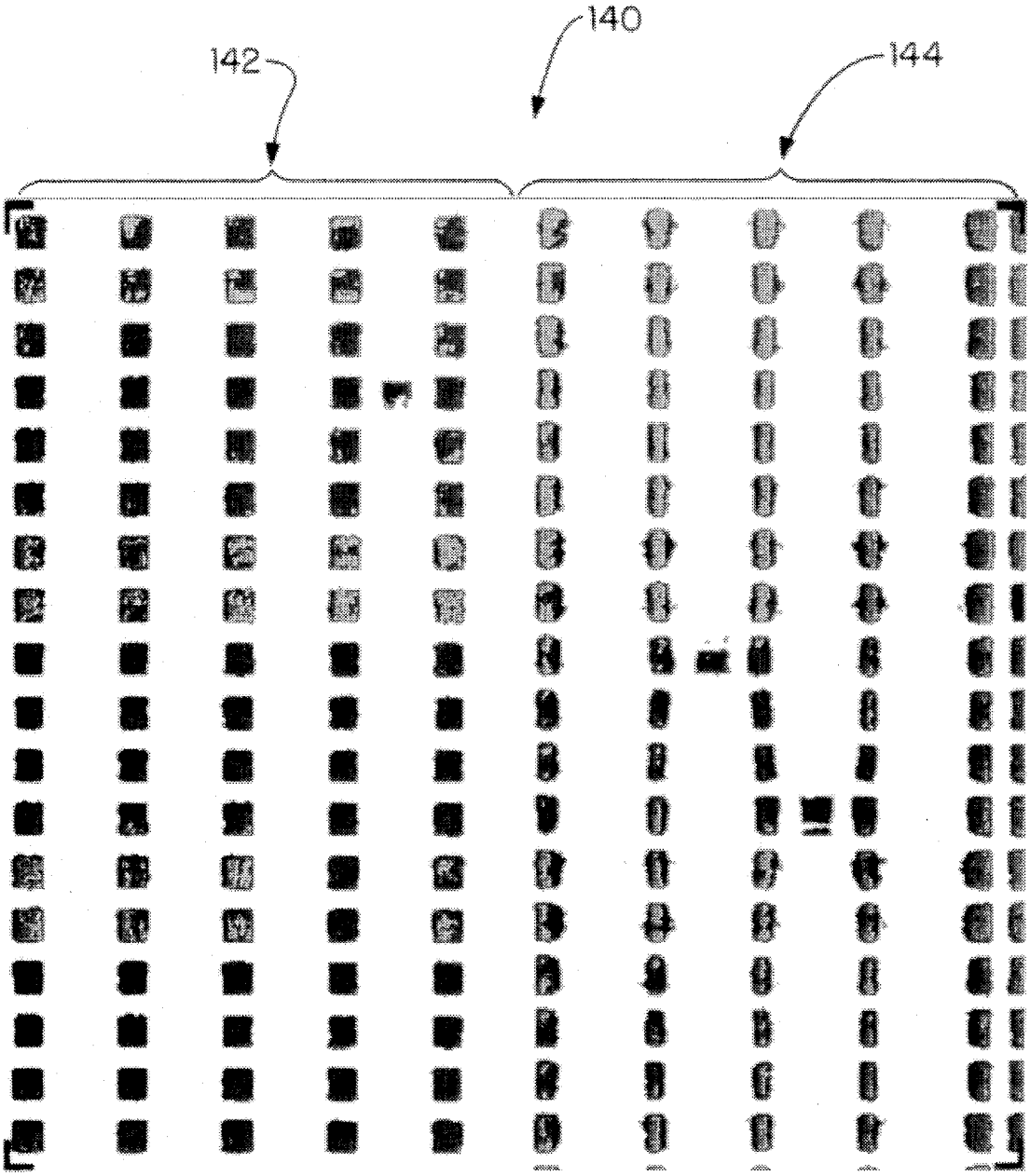
FIG. 12 (color) illustrates photometric data of the two sets of pixels in FIG. 11 in which alternating columns of pixels have been turned off and illustrating the coupling affect in the pixels without the apparatus of this invention and the lack of the coupling affect from the pixels including the apparatus of this invention.

Referring now to FIG. 12, alternating columns of both sets of pixels 142 and 144 are turned off, with the remaining columns left on. Note that the pixels 142, according to this invention, remain at their full size, having no noticeable diminished output. However, note that the larger pixels 144, not including the isolating grid of this invention, show significant shrinkage and reduced light output at the portions of the pixels next to pixels that have been turned off. This is similar to the effect shown in FIG. 2. This invention's advantage of decoupling neighboring pixels from the operational state of other neighboring pixels is clearly shown.

According to this invention, the size of the grid with respect to the pixel dimensions may vary as will be described herein. In general, as is known to those skilled in the art of reconfigurable displays, it is advantageous that the active pixel area, i.e., that portion of the pixel that, in the case of a vacuum fluorescent display is covered with phosphor and thereby is capable of responding to the applied controlling signals, be maximized with respect to the total pixel area (approximately the total display area divided by the number of pixels). The region of the pixel that cannot respond to control signals, i.e., that which is not covered by phosphor in the case of a vacuum fluorescent display, contributes to the graininess of the resultant image. Thus it is generally the practice of those involved in reconfigurable display development to minimize these inactive regions. In the present example, the technique used to pattern the phosphor (i.e., screen priming, photolithography, electrophoretic deposition, etc.) determine, to a large extent, the amount of inactive area between phosphor dots. For a given inactive area, according to this invention, better results are achieved as the size of the grid structure is increased. The maximum size is limited by the breakdown field in the vacuum and the voltage at which the display is operated.

Figure 13:
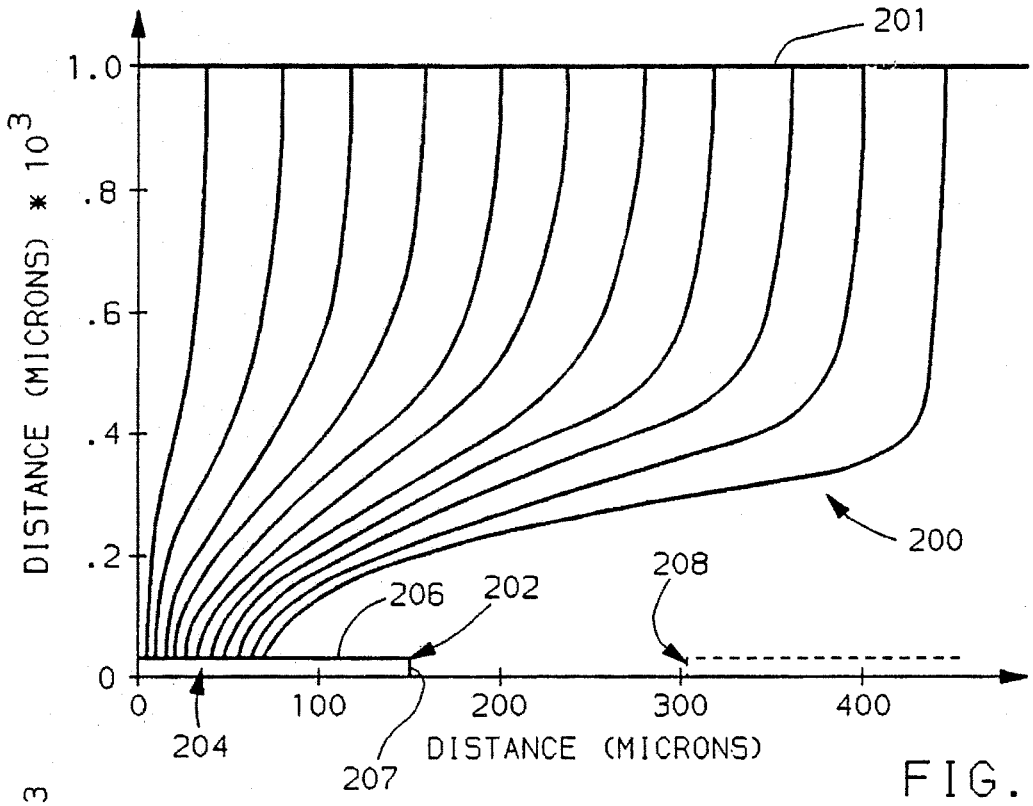
FIGS. 13, 14, 15, 16, 17, 18, 19, 20, 21, 22, 23 and 24 illustrate electric field behavior in display apparatus according to this invention.
Figure 14:
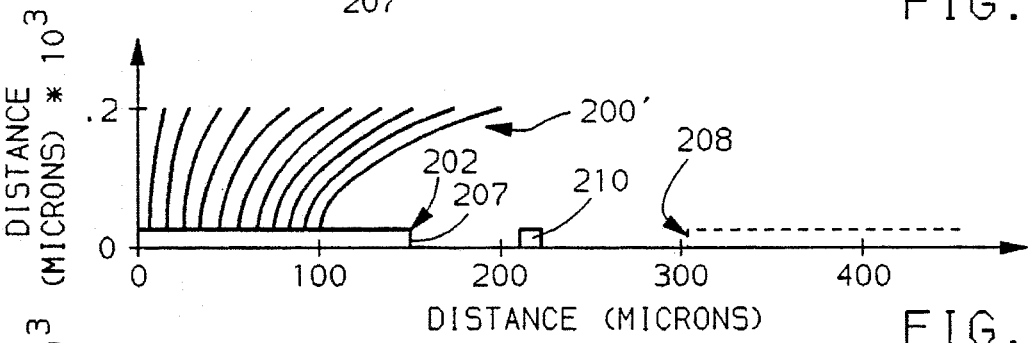
Figure 15:
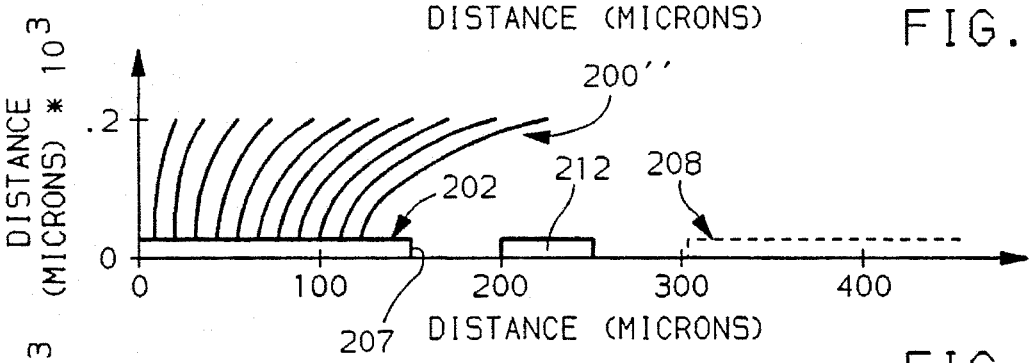
Figure 16:
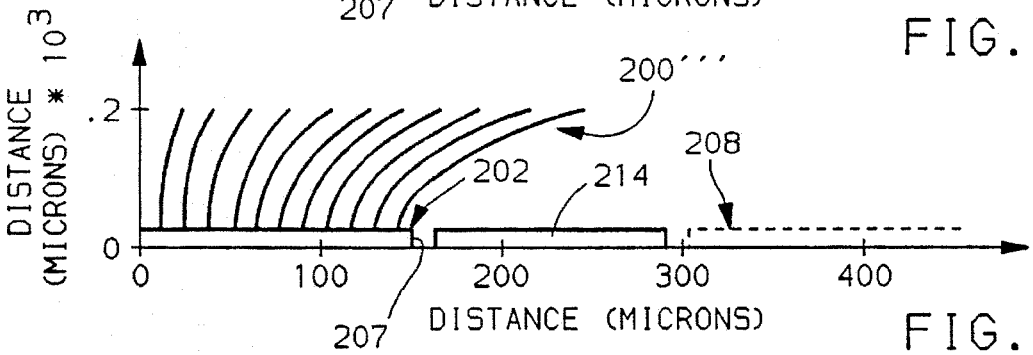

Examples of finite element modeling of a structure in which the separation between adjacent phosphor dots is 150 μm is shown in FIGS. 13, 14, 15 and 16, in which the filament to phosphor separation is constant. Referring to FIG. 13, in the case where no grid structure is used, it is seen that the electric field lines 200 from the filament 201 do not intercept the 80 μm (portion 206) of the turned on pixel 202 closest to pixel edge 207, which is the edge closest to pixel 208, which is turned off. The field lines intercept portion 204 of pixel 202, which portion 204 is illuminated. Referring to FIG. 14, for a display with a 10 μm wide grid 210, located 70 μm from each pixel 202, 208 the electric field lines 200' are pulled to within approximately 45 μm of the edge 207 of pixel 202 closest to turned off pixel 208. Referring to FIG. 15, for a display with a 50 μm wide grid 212, located 50 μm from each pixel 202, 208, the field lines 200" intercept pixel 202 within 35 μm of the edge 207 closest to turned off pixel 208. Referring to FIG. 16, for a display with a 130 μm wide grid 214 located 10 μm from each pixel 202, 208, the field lines 200' are pulled to within 15 μm of the edge 207 closest to turned off pixel 208. This modelling shows that, for a fixed pixel (phosphor dot) to pixel (phosphor dot) separation and for a fixed pixel (phosphor dot) to filament separation, as the separation between the pixels and grid is decreased, the portion of phosphor subjected to electron bombardment from the filament increases.

Generally, to reduce the graininess of the resultant image, the phosphor dot to phosphor dot separation for a reconfigurable vacuum fluorescent display is preferably less than or equal to 150 μm.

A parameter that affects undesirable coupling is the separation distance (FIG. 3, reference 23) between the phosphor dots and the filament. If the separation distance (FIG. 3, reference 25) between phosphor dots is greater than or equal to the separation 23 between the phosphor dots and the filament, the undesirable coupling effect may not noticeably occur because the fields in the vicinity of each pixel are directly controlled by the filament rather than by adjacent pixels. Typical commercially available vacuum fluorescent displays have a filament to phosphor distance of from 1 mm to 2 min. If this structure were used in a reconfigurable display with a separation between pixel pads of 150 μm or less, undesirable coupling will occur. The grid according to this invention advantageously reduces noticeable pixel interference when the filament to pixel distance is greater than the pixel to pixel distance.

Figure 17:
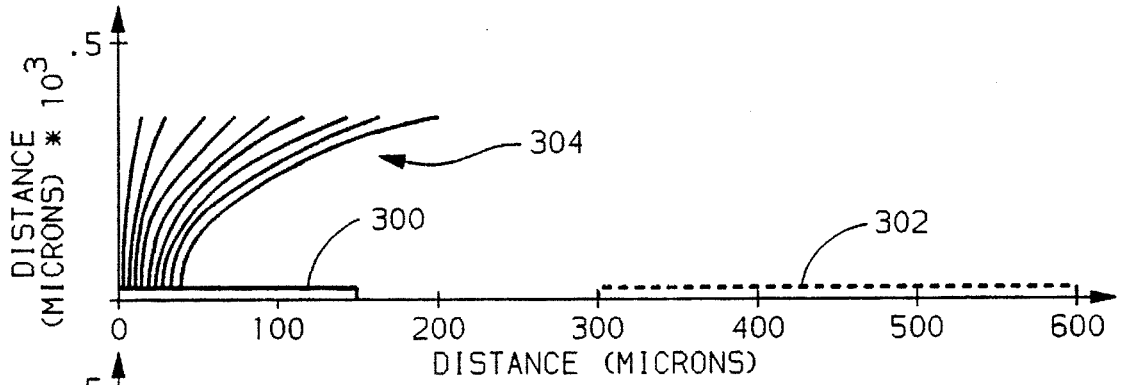
Figure 18:
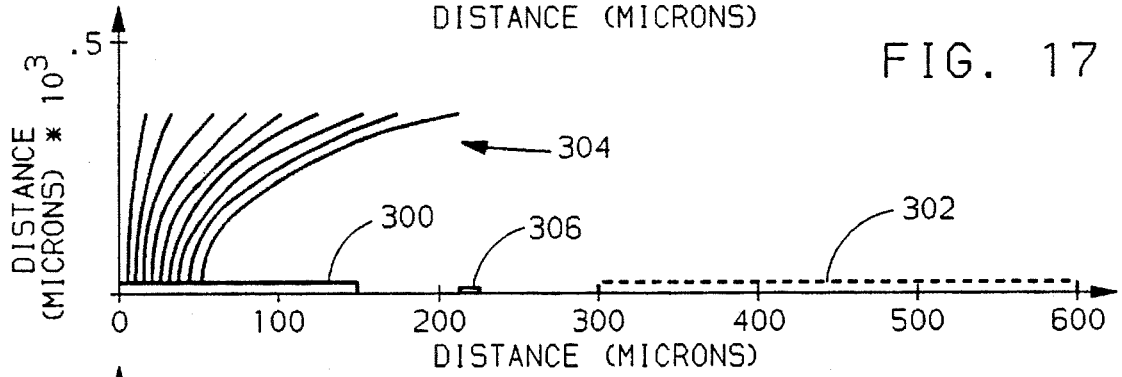
Figure 19:
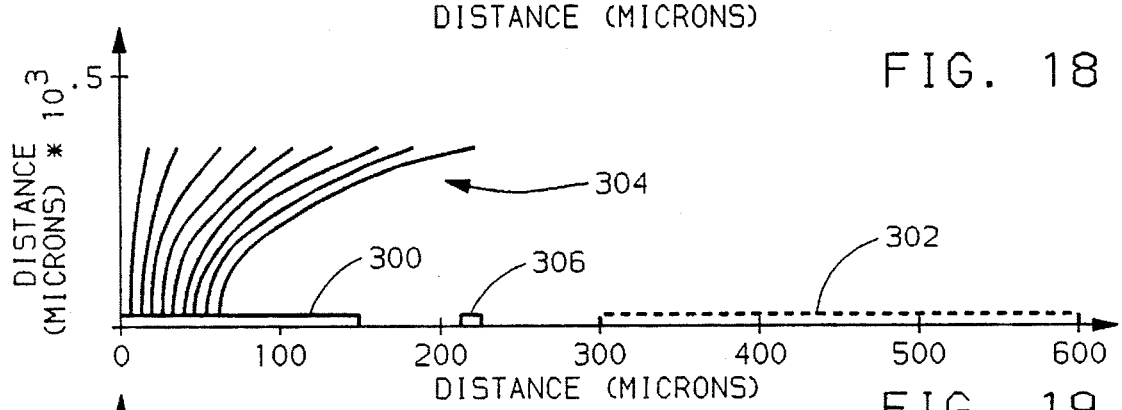
Figure 20:
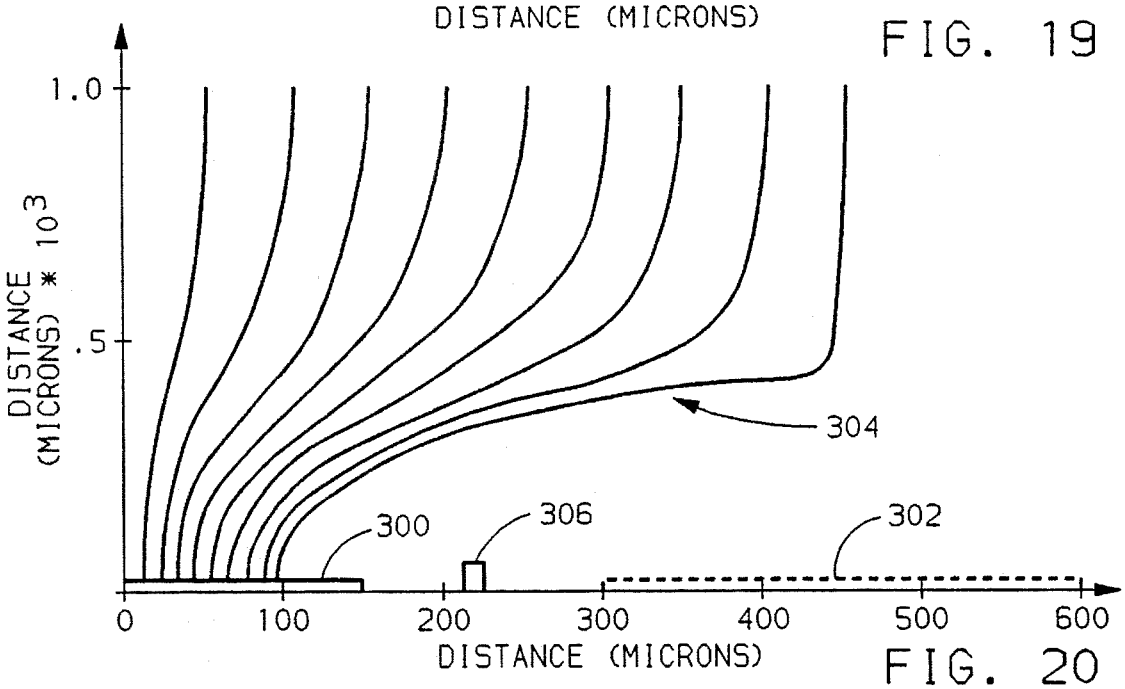
Figure 21:
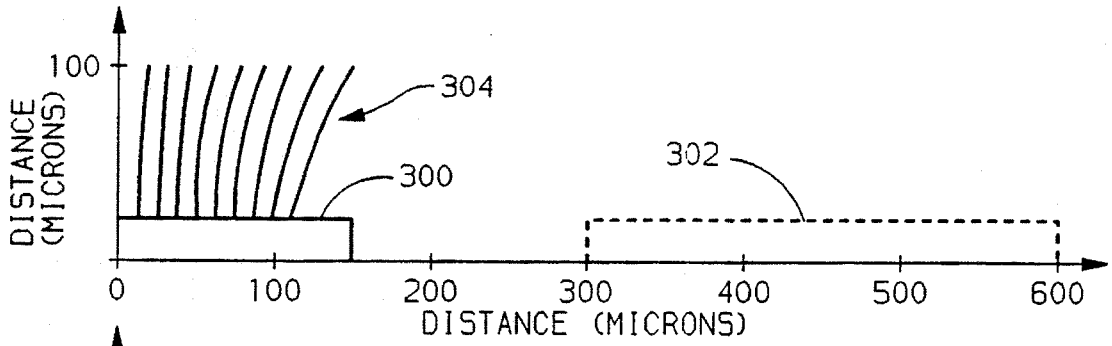

The effect of grid height upon electric field distribution across the phosphor area is shown in FIGS. 17, 18, 19 and 20 for an example display with pixel separation of 150 μm and a filament to substrate separation of 2000 μm. FIGS. 21, 22, 23 and 24 show the effect of grid height upon electric field distribution across the phosphor area for a display with pixel separation of 150 μm and a filament to substrate separation of 500 μm. In the Figures, reference 300 represents a pixel that is turned on and is neighboring a pixel 302 that is turned off. The electric field lines are designated as reference 304 and the grid, omitted in FIGS. 17 and 21, is shown at various relative heights in FIGS. 18–20 and 22–24 and designated generally by reference 306.

When the separation between the filament and substrate is large, 2000 μm, as shown in FIGS. 17–20, as the grid height increases above the height of the phosphor element (i.e., 25 μm), the electric field distribution across the phosphor advantageously improves. This is illustrated progressively in FIGS. 17 (no grid), 18 (grid height of 1 μm relative to the substrate), 19 (grid height of 10 μm relative to the substrate) and 20 (grid height of 50 μm relative to the substrate). Thus, advantageously according to this invention, in a display with a separation distance between the substrate and the filament in the range of 2 mm, the grid has a height relative to the substrate greater than the height of the phosphor element relative to the substrate, affecting improved independent operation of neighboring pixels in the display.

Figure 22:
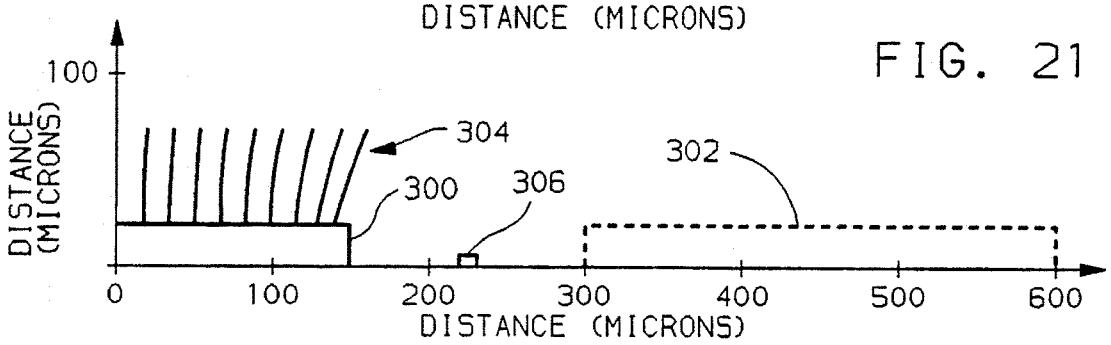
Figure 23:
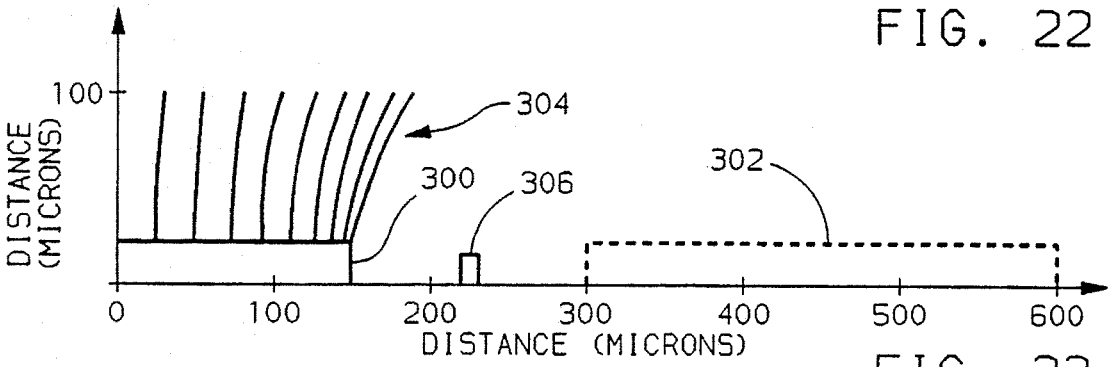
Figure 24:
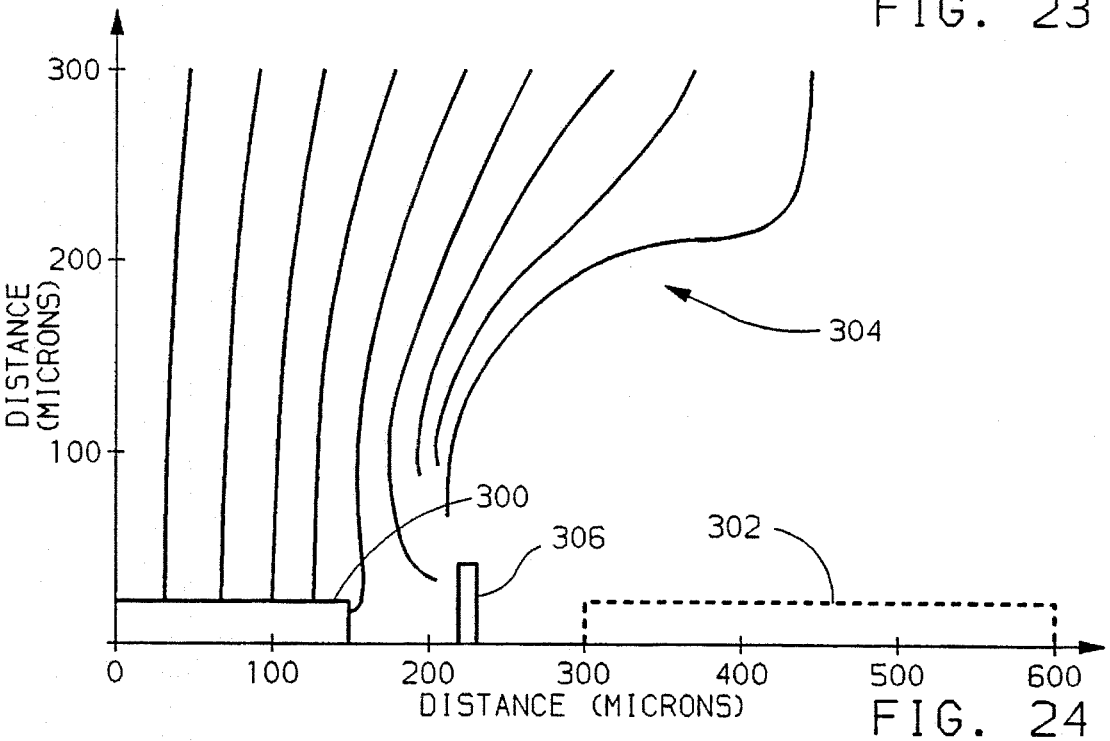

When the separation between the filament and the substrate is small, 500 μm, as shown in FIGS. 21–24, increasing the height of the grid significantly beyond that of the phosphor element results in the collection of undue amounts of filament current by the grid 306, due to the termination of field lines on the grid 306, shown in FIG. 24. The grid height relative to the substrates in FIGS. 22, 23 and 24 is 1, 10 and 50 μm, respectively. Thus, in cases with a small separation distance between the filament and substrate, it is preferred that the grid be the height of approximately 10 μm, or the height of the phosphor elements, to ensure ideal field distribution without drawing excessive grid current. For many displays, the separation between the filament and substrate is intermediate between the two cases shown. For such displays, the preferred grid height is generally approximately the same as the height of the phosphor elements. If, due to processing constraints or design choice, this cannot (or will not) be achieved in a particular implementation (as will often be the case), the advantageous results of this invention can still be obtained by a smaller grid height.

EXAMPLE 3

Advantageously, according to this invention, there is provided an apparatus of an active matrix reconfigurable vacuum fluorescent display comprising a silicon substrate, a bulk fabricated transistor array fabricated into the silicon substrate, an insulating layer applied in a pattern onto the silicon substrate with the transistor array fabricated therein, pixel pads coupled to the transistor array and around which the insulation layer is applied and an isolating grid on the insulating layer surrounding all portions of each pixel having a neighboring pixel.

Figure 25:
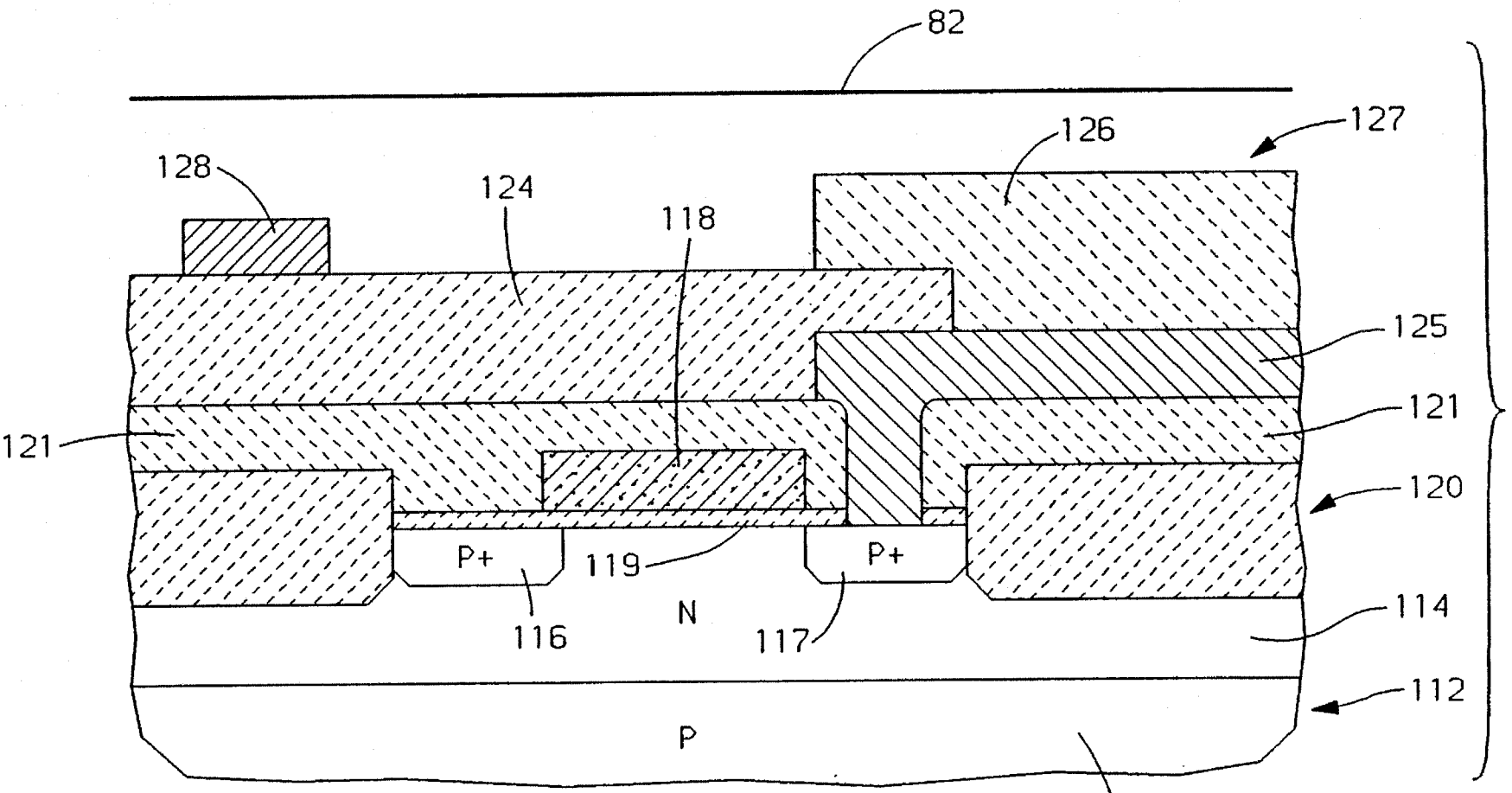
FIG. 25 illustrates a cross-section of another example implementation of the apparatus of this invention.

Referring to FIG. 25, an example of a cross-section of a display fabricated according to this invention using bulk CMOS technology on a silicon wafer is shown. The cross-section illustrates the silicon wafer 112 having a portion 114 serving as an N-well for a fabricated transistor array on a P-type substrate 115. The transistor array comprises a set of matrix addressable transistors 120 for actively controlling each pixel 127 and is fabricated and forms a circuit well known to those skilled in the art. The transistors comprise p-type sources 116 and drains 117 and polysilicon gates 118, coupled to the sources 116 and drains 117 with narrow silicon dioxide layer 119. The fabrication of bulk CMOS transistors 120, onto the substrate, and the composite insulator layers 121, 124, aluminum pixel pads 125 and phosphor dots 126 is well known to those skilled in the art. Each pixel 127 includes a pad 125 comprising the pixel anode, which is coupled to the drain of the driving transistor 120 for that pixel. Composite insulator layers 121, 124 cover the bulk of the surface of the wafer leaving the pads 125 exposed along with row and column connection pads, if required.

The isolating grid 128 is fabricated on top of the insulating layer 120 and may be the narrow grid 128 shown or may be in the form of the large area grid.

As is apparent to one skilled in the art in view of the above various example implementations, this invention is suitable for use with any type of active matrix vacuum fluorescent display, and need not be limited to TFT driven displays or CMOS driven displays.

While the examples set forth herein do not include a wire mesh grid to aid in uniform electron bombardment, this invention may be used in displays with a wire mesh grid physically interposed between the filament and phosphor and biased at a voltage intermediate between the bias voltages of the filament and the phosphor anode.

The above implementations are example implementations. Moreover, various other improvements and modifications to this invention may occur to those skilled in the art and will fall within the scope of this invention as set forth below.

The embodiments of the invention in which an exclusive property or privilege is claimed are defined as follows:

1. A display comprising:

a source of electron emission or acceleration;

a set of pixel pads on a substrate;

a set of phosphor elements on the pixel pads;

a grid on the substrate;

wherein, the source has a distance of less than 2 mm from the substrate, wherein the pixels have a separation distance between neighboring pixels of less than 500 μm, wherein the grid has a first height relative to the substrate generally substantially equal to a second height of the phosphor elements relative to the substrate.

2. The display of claim 1, wherein the separation distance between neighboring pixels is in the range of 150 μm.

3. The display of claim 1, wherein the separation distance between neighboring pixels is in the range of 100 μm.

4. A display comprising:

a source of electron emission or acceleration;

a set of pixel pads on a substrate;

a set of phosphor elements on the pixel pads;

a grid on the substrate;

wherein, the source has a distance of at least 1.5 mm from the substrate, wherein the pixels have a separation distance between neighboring pixels of less than 500 μm, wherein the grid has a first height relative to the substrate greater than a second height of the phosphor elements relative to the substrate.

5. The display of claim 4, wherein the separation distance between neighboring pixels is in the range of 150 μm.

6. The display of claim 4, wherein the separation distance between neighboring pixels is in the range of 100 μm.

7. A display comprising:

a source of electron emission or acceleration;

a set of pixel pads on a substrate;

a set of phosphor elements on the pixel pads;

an isolation grid on the substrate;

wherein, the source has a distance of less than 2 mm from the substrate, wherein the pixels have a separation distance between neighboring pixels of less than 500 μm, and wherein the isolation grid is biased to an isolation potential to thereby prevent operative coupling between neighboring pixels of the set of pixel pads.

8. The display of claim 7, wherein the isolation grid has a thickness between 0.2 and 1.5 μm.

9. A display comprising:

a source of electron emission or acceleration;

a set of pixel pads on a substrate;

a set of phosphor elements on the pixel pads;

an isolation grid on the substrate;

wherein, the source has a distance of at least 1.5 mm from the substrate, wherein the pixels have a separation distance between neighboring pixels of less than 500 μm, and wherein the isolation grid is biased to an isolation potential to thereby prevent operative coupling between neighboring pixels of the set of pixel pads.

10. The display of claim 9, wherein the isolation grid has a thickness between 0.2 and 1.5 μm.

* * * * *